US008720580B1

(12) United States Patent
Lugo

(10) Patent No.: US 8,720,580 B1
(45) **Date of Patent: *May 13, 2014**

(54) SYSTEM AND METHOD FOR DIVERTING FLUIDS FROM A DAMAGED BLOWOUT PREVENTER

(75) Inventor: Mario R. Lugo, Houston, TX (US)

(73) Assignee: Trendsetter Engineering, Inc., Houston, TX (US)

( * ) Notice: Subject to any disclaimer, the term of this patent is extended or adjusted under 35 U.S.C. 154(b) by 120 days.

This patent is subject to a terminal disclaimer.

(21) Appl. No.: 13/269,769

(22) Filed: Oct. 10, 2011

Related U.S. Application Data

(63) Continuation-in-part of application No. 13/160,032, filed on Jun. 14, 2011.

(51) Int. Cl.

| | |
|---|---|
| ***E21B 43/01*** | (2006.01) |
| ***E21B 33/06*** | (2006.01) |
| ***E21B 33/076*** | (2006.01) |
| ***E21B 33/064*** | (2006.01) |

(52) U.S. Cl.
USPC ..... 166/344; 166/345; 166/363; 166/364; 166/338; 166/347; 251/1.1

(58) Field of Classification Search
USPC ..... 166/344, 345, 363, 364, 338, 347; 137/884; 251/11
See application file for complete search history.

(56) References Cited

U.S. PATENT DOCUMENTS

| | | | | |
|---|---|---|---|---|
| 3,545,541 | A * | 12/1970 | DeVries | 166/95.1 |
| 4,324,505 | A | 4/1982 | Hammett | |
| 4,405,258 | A | 9/1983 | O'Rourke et al. | |
| 4,444,250 | A | 4/1984 | Keithahn et al. | |
| 4,502,534 | A | 3/1985 | Roche et al. | |
| 4,646,844 | A | 3/1987 | Roche et al. | |
| 4,828,024 | A | 5/1989 | Roche | |
| 5,213,162 | A * | 5/1993 | Iato | 166/341 |
| 5,323,860 | A | 6/1994 | Watkins | |
| 5,676,209 | A * | 10/1997 | Reynolds | 166/345 |
| 5,984,012 | A | 11/1999 | Wactor et al. | |
| 6,230,824 | B1 | 5/2001 | Peterman et al. | |
| 6,460,621 | B2 * | 10/2002 | Fenton et al. | 166/347 |
| 6,832,874 | B2 * | 12/2004 | Appleford et al. | 405/189 |
| 7,134,498 | B2 * | 11/2006 | Hopper | 166/357 |
| 7,165,619 | B2 | 1/2007 | Fox et al. | |
| 7,308,954 | B2 | 12/2007 | Martin-Marshall | |
| 7,597,811 | B2 | 10/2009 | Usher | |
| 7,921,917 | B2 * | 4/2011 | Kotrla et al. | 166/339 |
| 8,365,830 | B2 * | 2/2013 | Kotrla et al. | 166/338 |
| 2006/0037782 | A1 | 2/2006 | Martin-Marshall | |
| 2007/0119595 | A1 * | 5/2007 | Carlsen et al. | 166/368 |
| 2009/0095464 | A1 | 4/2009 | McGrath et al. | |
| 2009/0260829 | A1 | 10/2009 | Mathis | |

(Continued)

*Primary Examiner* — James Sayre
(74) *Attorney, Agent, or Firm* — Egbert Law Offices, PLLC

(57) ABSTRACT

A system for capping a blowout preventer has a capping stack with a connector suitable for connection to the blowout preventer, a flowing stack, and an intervention blowout preventer connected to a connector of the flowing stack. The capping stack has a fluid passage extending from the connector. The capping stack has at least one diverter line in communication with the fluid passage. The flowing stack has an interior passageway extending to the connector at an upper end thereof. The flowing stack has at least one pipe in communication with the interior passageway. The pipe is connected with the diverter line of the capping stack such that a flow fluid passing through the diverter line passes through the pipe into the interior passageway of the flowing stack.

9 Claims, 7 Drawing Sheets

(56) References Cited

U.S. PATENT DOCUMENTS

2011/0005766 A1* 1/2011 Shand ..... 166/345
2012/0018165 A1* 1/2012 Crossley et al. ..... 166/344
2012/0048566 A1* 3/2012 Coppedge et al. ..... 166/340
2012/0055679 A1* 3/2012 Van Winkle ..... 166/363
2012/0217020 A1* 8/2012 Edwards et al. ..... 166/363

* cited by examiner

SYSTEM AND METHOD FOR DIVERTING FLUIDS FROM A DAMAGED BLOWOUT PREVENTER

CROSS-REFERENCE TO RELATED APPLICATIONS

The present application is a continuation-in-part of U.S. patent application Ser. No. 13/160,032, filed on Jun. 14, 2011, and entitled "Diverter System for a Subsea Well", presently pending.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to systems for diverting the flow of hydrocarbons from a blowout preventer. More particularly, the present invention the relates to diverters that are applied to the outlet of a blowout preventer so as to provide a safety mechanism in the event of a failure of the blowout preventer. Additionally, the present invention relates to capping stack that are utilized for the purpose of diverting the flow of high pressure fluids to a surface location.

2. Description of Related Art Including Information Disclosed Under 37 CFR 1.97 and 37 CFR 1.98.

As the worldwide demand for hydrocarbon fuel has increased, and known onshore reserves have not kept up with the demand, there has been increasing activity in offshore oil exploration and production. Reserves of oil known to exist in the offshore areas have steadily increased and an increasing percentage of world production is from these offshore areas. The offshore environment has presented numerous new challenges to the oil drilling industry which have been steadily overcome to allow efficient drilling and production in these areas, although the costs have been considerably higher than those of onshore operations.

Not only has the offshore environment made production more difficult to accomplish, it has also generally increased the risk of environmental damage in the event of a well blowout or other uncontrolled loss of hydrocarbons into the sea. As a result, known safety equipment, such as blowout preventers which have been used successfully in onshore operations, have been used in offshore operations also. In spite of safety precautions, blowouts of offshore oil wells are known to occur and will occur in the future.

Subsea drilling operations may experience a blowout, which is an uncontrolled flow of formation fluids into the drilling well. These blowouts are dangerous and costly, and can cause loss of life, pollution, damage to drilling equipment, and loss of well production. To prevent blowouts, blowout prevention equipment is required. This blowout prevention equipment typically includes a series of equipment capable of safely isolating and controlling the formation pressures and fluids at the drilling site. BOP functions include opening and closing hydraulically-operated pipe rams, annular seals, shear rams designed to cut the pipe, a series of remote-operated valves to allow control the flow of drilling fluids, and well re-entry equipment. In addition, process and condition monitoring devices complete the BOP system. The drilling industry refers to the BOP system as the BOP stack.

The well and the BOP connect the surface drilling vessel to amarine riser pipe, which carries formation fluids (e.g., oil, etc.) to the surface and circulates drilling fluids. The marine riser pipe connects to the BOP through the Lower Main Riser Package (LMRP) which contains a device to connect to the BOP, an annular seal for well control, and flow control devices to supply hydraulic fluids for the operation of the BOP. The LMRP and the BOP are commonly referred to, collectively, as simply the BOP. Many BOP functions are hydraulically controlled, with piping attached to the riser supplying hydraulic fluids and other well control fluids. Typically, a central control unit allows an operator to monitor and control the BOP functions from the surface. The central control unit includes a hydraulic control system for controlling the various BOP functions, each of which has various flow control components upstream of it.

While many of the techniques used in onshore operations can be applied in the offshore environment, they often prove to be less effective and require a much longer time period for implementation. For example, while relief wells can drilled to intercept the blowout well, a great amount of time may be required in the drilling operation. In drilling the relief wells, platforms or other drilling support decks must be located and transported to the blowout site before drilling operations can begin. Due to the rugged offshore environment, more time is required to drill the relief wells than would be required in onshore operations. As a result of all of these difficulties, many months can pass between the occurrence of an offshore oil well blowout and the successful final capping of the blown-out well. In the intervening time, large quantities of oil and gas can escape into the ocean with serious environmental impact.

While a portion of the hydrocarbons lost from a subsea well blowout may be trapped and skimmed by various containment booms and oil skimmer ships, substantial quantities of hydrocarbons can still escape such containment equipment. It can be seen that once the hydrocarbons are allowed to reach the ocean, surface wave action tends to disburse the lighter hydrocarbons which may mix with water or evaporate into the air. The gaseous hydrocarbons, of course, tend to escape into the atmosphere. The heavier ends of the crude oil often form into globules or tar balls which may flow at, or just below, the water's surface so as to make it difficult to contain or to skim up.

One of the problems associated with diverter systems for such blowout preventers is that, under certain circumstances, the pressure of the fluid released from the blowout preventer is of extremely high pressures, up to 15,000 p.s.i. When such pressures are involved, it is not possible to use conventional hoses in order to move such fluids to a subsea manifold or a subsea tree. Typically, such hoses would not have the capacity to withstand the pressures of such high pressure fluids. As such, further control of the diverter system is required so as to avoid the circumstance in which such hydrocarbons are passed under such high pressures into equipment that is not capable of withstanding such high pressures.

When such high pressures are encountered, typically, the excess pressure is diverted as a release into the water. Such hydrocarbon releases are extremely undesirable because of environmental consequences. Additionally, if such pressures are not released, it is possible that such high pressures could eventually cause a further subsea blowout of the subterranean formation at a location away from the well. As such, it is extremely important to be able to effectively release the pressures from the well in order to avoid the possibility of another subterranean blowout.

Whenever the high pressure hydrocarbons are released into the subsea environment. A waste of the hydrocarbons will occur. If a substantial amount of such hydrocarbons are released, then the production of such hydrocarbons is diminished. As a result, it is desirable to recapture such hydrocarbons and to avoid the release of such hydrocarbons into the subsea environments.

In past diversion systems, a variety of components are connected to a capping stack or a diverter system. These components involve the connection of various hoses to the subsea tree, to the subsea mandrel, or to other apparatus in the subsea environment. This is a very complicated and time-consuming procedure. Several ROVs would be required in order to complete such installations. The completion of such installations can be very difficult considering the nature of the blowout. The equipment often needs to be transported from remote locations in order to be effectively installed. As such, it would be desirable to be able to provide a system whereby the equipment necessary for the capping of the damaged blowout preventer is easily available or made available in the location of the blowout.

In the past, various patents and patent publications have issued relating to systems for the containment of oil spills and blowouts. For example, U.S. Pat. No. 4,324,505, issued on Apr. 13, 1982 to D. S. Hammett, discloses a subsea blowout containment method and apparatus. This blowout containment apparatus comprises an inverted funnel adapted for positioning over a wellhead to receive fluids from the well and direct them into a conduit extending from the funnel to surface support and processing equipment. The funnel and conduit are supported from the sea's surface, preferably by a vessel such as a barge. The barge carries the equipment to receive the full flow of fluids from the well, to process the fluids, and to conduct the liquids to a nearby tanker where the recovered liquid hydrocarbons may be stored.

U.S. Pat. No. 4,405,258, issued on Sep. 20, 1983 to O'Rourke et al., describes a method for containing oil and/or gas within a blow-out cover dome. This method includes the steps of deploying a containment dome in shallow water near the location of the seabed where the containment dome is to be located. The containment dome has an upper expanded dome-like fluid impervious membrane, a fluid impervious hollow peripheral ring attached to the periphery of the membrane to provide a depending bag-like container, and discrete water drainage means within the bag-like container for connection to pump conduit means therefrom. Wet sand from the seabed is then pumped into the bag-like container. Water is then drained from the wet sand through the water drainage means so as to provide a body of drained sand disposed within the bag-like container and providing a hollow peripheral ring as a hollow peripheral torus acting as a self-supporting structure and as an anchor for the dome-like structural unit. The dome is then charged with a buoyant amount of air and the buoyed dome is floated out to the site where the dome is to be deployed. It is then submerged by controllably releasing the air while substantially simultaneously filling the dome with water, thereby sinking the dome until the lighter-than-water fluid is captured within the dome.

U.S. Pat. No. 4,828,024, issued on May 9, 1989 to J. R. Roche, describes a diverter system and blowout preventer. The system comprises a blowout preventer attached above a spool having a hydraulically-driven sleeve/piston. An outlet flow passage exists in the spool. This outlet flow passage can be connected to a vent line. The outlet flow passage is closed off by the sleeve wall when the spool piston is at rest. Hydraulic ports are connected above and below the blowout preventer annular piston and above and below the spool annular piston. The ports below the blowout preventer piston and above the spool piston are in fluid communication with each other. A hydraulic circuit is provided having two valves between a source of pressurized hydraulic fluid and a drain.

U.S. Pat. No. 5,984,012, issued on Nov. 16, 1999 to Wactor et al., provides an emergency recovery system for use in a subsea environment. This emergency recovery system has a casing that is open at each end with a shackle connected to one end of the casing with the opposite end of the shackle designed for connection to appropriate points on the main stack and lower marine riser package in any orientation. A flexible sling with a closed loop formed at each end is used with one of the closed loops releasably connected to the shackle and the end of the casing. The other end of the sling has a flotation member attached to the sling adjacent the closed loop. The sling is fan folded as it is lowered into the casing. The flotation member is shaped to fit inside the other end of the casing with the closed end loop of the sling protruding from the casing. The flotation member is constructed of synthetic foam and is sized to provide sufficient buoyancy to fully extend the sling when the release ring is released by a remotely operated vehicle in a subsea environment.

U.S. Pat. No. 7,165,619, issued on Jan. 23, 2007 to Fox et al., teaches a subsea intervention system that includes a BOP module and CT module. A tool positioning system is used for positioning a selected subsea tool stored within a rack with a tool axis in line with the BOP axis, while a marinized coiled string injector is moved by positioning system to an inactive position. Power to the subsea electric motors is supplied by an electrical line umbilical extending from the surface for powering the pumps. An injector is provided that includes a pressure compensator roller bearing and a pressure-compensated drive system case.

U.S. Pat. No. 7,597,811, issued on Oct. 6, 2009 to D. Usher, provides a method and apparatus for subsurface oil recovery using a submersible unit. The submersible vehicle is positioned above the bed of a diver supported on a platform above the pollutant. A wand at one end of a pipe evacuated by a centrifugal pump is manipulated to draw the pollutant to the surface for treatment or disposal.

U.S. Pat. No. 7,921,917, issued on Apr. 12, 2011 to Kotrla et al., shows a multi-deployable subsea stack system. This subsea stack system includes a lower marine riser package, a blowout preventer stack with a first ram blowout preventer, and an additional blowout preventer package releasably coupled to the blowout preventer stack and comprising a second ram blowout preventer. The subsea blowout preventer stack assembly can be deployed by coupling a drilling riser to the lower marine riser package that is releasably connected to the blowout preventer stack. The lower marine riser package and blowout preventer stack are then attached to a subsea wellhead and then landed on the additional blowout preventer package that is coupled to the subsea wellhead.

U.S. Patent Publication No. 2009/0095464, published on Apr. 16, 2009 to McGrath et al., provides a system and method for providing additional blowout preventer control redundancy. This system has backup or alternate fluid flow routes around malfunctioning BOP control components using a remotely-installed removable hydraulic hose connection. The backup fluid flow route sends pressure-regulated hydraulic fluid to a BOP operation via an isolation valve rigidly attached to the BOP, then to a hose connected to an intervention panel on the BOP, and finally through a valve that isolates the primary flow route and establishes a secondary flow route to allow continued operation.

U.S. Patent Publication No. 2009/0260829, published on Oct. 22, 2009 to D. J. Mathis, provides a subsea tree safety control system that limits the probability of failure on demand of a subsea test tree. A safety shut-in system is provided for actuating a safety valve of the subsea test tree. The safety shut-in system includes a surface control station positioned above a water surface connected via an umbilical to a subsea control system positioned below the water surface so as to actuate the safety valve.

U.S. Pat. No. 4,444,250, issued on Apr. 24, 1984 to Keithahn et al., teaches a flow diverter apparatus having a housing and a piston with an annular packer disposed therein. The diverter has passages in the piston and housing walls providing fluid communication between the borehole and a vent line. A valve in the vent line is opened before the packer of the apparatus is closed about a tubular member in the bore or completely closes the vertical flow path of the bore. This diverts pressurized borehole fluid away from the rig equipment and personnel.

U.S. Pat. No. 4,502,534, issued on Mar. 5, 1985 to Roche et al., describes a flow diverter for connection to a drilling conduit beneath a drilling rig floor for diverting pressurized well bore fluid in the conduit from the rig and sealing the annulus between a pipe or other object and the conduit or closing the vertical flow path of the conduit. The apparatus has a housing, and annular packing element and two pistons. The housing is provided with at least one outlet passage in the wall of its body. One of the two pistons acts as a sliding sleeve valve in cooperation with the housing wall for preventing fluid communication between the outlet passage and the interior of the housing when it is in a nonactuated or normal position and for allowing fluid communication when it is in an actuated or diverting position.

U.S. Pat. No. 4,646,844, issued on Mar. 3, 1987 to Roche et al., shows a diverter/BOP system and method for a bottom-supported offshore drilling rig. The system includes a fluid flow controller and at least two bases adapted for being alternatively removably secured to the controller. When the first base is in combination with the fluid flow controller, the system may be used only as a diverter and when the second base is used in combination with the fluid flow controller the system may be used only as a blowout preventer.

U.S. Pat. No. 5,323,860, issued on Jun. 28, 1994 to B. J. Watkins, describes an apparatus for connecting a diverter assembly to a blowout preventer stack. An upper tubular member is adapted to be connected to the diverter assembly to form a lower continuation of the lower end of its bore. A lower tubular member is adapted to be connected to the blowout preventer stack to form an upper continuation of the upper end of its bore. A tubular body extends between and is pivotally and sealably connected to the upper and lower tubular members to connect their bores.

U.S. Pat. No. 6,230,824, issued on May 15, 2001 to Peterman et al., teaches a rotating subsea diverter for isolating fluid in a well from other fluid above the well. The rotating diverter includes a housing body which has a bore running through it. A retrievable spindle assembly includes a spindle and a bearing assembly that is disposed in the bore. The bearing assembly supports the spindle for rotation. The spindle is adapted to receive and seal around a tubular member. The rotation of the tubular member rotates the spindle within the bore.

U.S. Pat. No. 7,308,954, issued on Dec. 18, 2007 to P. S. Martin-Marshall, shows a rotating diverter head for use on a blow out preventer stack of an oil well. The head provides for sealing and rotation of a drill pipe through the head and includes a flange on which the head is rotatable. The flange connects the head to the stack whereupon it can be rotated to align a return flow line before being locked in position.

U.S. Patent Publication No. 2006/0037782, published on Feb. 23, 2006 to P. S. Martin-Marshall, describes a monitoring system for a rotating diverter head for use in an oil well. The system includes a pressure sensor which is mounted beside the stripper rubber which contacts the drill pipe. An increase in the pressure monitored provides early warning of degradation or imminent failure of the seal.

It is an object of the present invention to provide an apparatus for containing the flow of fluids resulting from a damaged or defective blowout preventer.

It is another object of the present invention to provide a system that is attachable to a blowout preventer so as to contain the flow of fluids in the event of a blowout preventer.

It is another object of the present invention to provide a system and method that can recover substantially all of the fluids flowing from the blowout preventer and for preventing the mixing of such fluids with seawater.

It is another object of the present invention to provide a system and method whereby high pressure fluids from the subsea well can be effectively contained and/or transported to the surface.

It is another object of the present invention to provide a system and method which avoids the need for connecting hoses, manifolds, and other subsea equipment to the diverter.

It is still a further object of the present invention to provide a system and method which can effectively utilize equipment in the vicinity of the damaged blowout preventer.

It is still another object of the present invention to provide a method and apparatus whereby high pressure fluids up to 15,000 p.s.i. can be effectively managed and contained.

It is still a further object of the present invention to provide a system and method whereby the equipment utilized for the capping of the damaged blowout preventer is easily installed with conventional equipment.

These and other objects and advantages of the present invention will become apparent from a reading of the attached specification and appended claims.

BRIEF SUMMARY OF THE INVENTION

The present invention is a system for capping a blowout preventer that comprising a capping stack having a connector suitable for connection to the blowout preventer, a flowing stack connected to the capping stack and having an interior passageway extending to a connector at an upper end thereof, and an intervention blowout preventer connected to a connector of the flowing stack. The capping stack has a fluid passage extending from the connector. The capping stack has at least one diverter line in communication with the fluid passage. The diverter line also has an outlet. The flowing stack has at least one pipe in communication with the interior passageway of the flowing stack. The pipe is connected with the diverter line of the capping stack such that a flow of fluid passing through the diverter line passes through the pipe into the interior passageway of the flowing stack.

The present invention also includes a lower marine riser package affixed to a connector of the intervention blowout preventer at an end opposite the flowing stack. A choke-and-kill line is connected to the lower marine riser package. The choke-and-kill line extends upwardly therefrom.

The diverter line includes a first diverter line in valved communication with the fluid passage of the capping stack. The diverter line also includes a second diverter line in valved communication with the fluid passage of the capping stack. The pipe has a first pipe in communication with the interior passageway of the flowing stack and connected to the first diverter line. A second pipe is also in communication with the interior passageway of the flowing stack and is connected to the second diverter line.

The capping stack has a mandrel at an upper end thereof. The flowing stack has another connector engaged with the mandrel of the capping stack. The capping stack also has a guide funnel opening at an upper end thereof. The flowing stack has a guide post slidably received in the guide funnel of the capping stack. The guide funnel of the capping stack includes a first guide funnel and a second guide funnel in spaced relationship. The guide post of the flowing stack includes a first guide post received in the first guide funnel and a second guide post received in the second guide funnel. The first guide post has a length shorter than a length of the second guide post. Each of the diverter lines and the pipe has a capacity of 15,000 p.s.i.

The present invention is also a flowing stack for passing fluid from a blowout preventer. The flowing stack comprises a frame, a body affixed to the frame having an interior passageway formed therein, and at least one pipe in fluid communication with the interior passageway of the body. The interior passageway of the body has an outlet at an upper end of the body. The pipe extends downwardly therefrom so as to have an inlet at a lower end thereof. The pipe has a connector at this inlet.

The pipe is in valved communication with the interior passageway. In particular, there is a first pipe in valved fluid communication with the interior passageway of the body and a second pipe in spaced relation to the first pipe and in valved fluid communication with the interior passageway of the body. A guide post is affixed to the frame and extends vertically downwardly therefrom. This guide post includes a first guide post and a second guide post each extending vertically downwardly from the frame. The second guide post is in spaced relation to the first guide post. The first guide post has a length shorter than a length of the second guide post. The first guide post and the second guide post have longitudinal axes parallel to the longitudinal axis of the interior passageway. The first guide post and the second guide post are positioned on opposite sides of the longitudinal axis of the interior passageway. The frame has a mandrel extending therefrom. The outlet of the interior passageway opens through the mandrel.

The present invention is also a method of diverting fluid from a damaged blowout preventer. This method includes the steps of: (1) positioning a capping stack onto an upper end of the damaged blowout preventer; (2) lowering a flowing stack onto the capping stack; (3) connecting the pipe of the flowing stack with the diverter line of the capping stack; and (4) affixing an intervention blowout preventer onto the outlet of the flowing stack. The capping stack has a fluid passage therein. The diverter line of the capping stack is in fluid communication with the fluid passage. This diverter line extends upwardly. The flowing stack has an interior passageway with an outlet at an upper end thereof. The flowing stack has a pipe in communication with the interior passageway.

The flowing stack has a guide post extending downwardly therefrom. The capping stack has a funnel opening at an upper end thereof. The method of the present invention further includes the steps of: (1) inserting the guide post into the funnel; and (2) lowering the flowing stack toward the capping stack until the guide post nests in the funnel.

The method of the present invention further includes the steps of connecting a choke-and-kill line to an outlet of the intervention blowout preventer and extending the choke-and-kill line to a surface location. Fluids flow from the damage blowout preventer through the fluid passage of the capping stack and outwardly through the diverter line. The fluids pass from the diverter line into the pipe of the flowing stack. The fluids flow from the pipe into the interior passageway of the flowing stack. The fluids pass from the interior passageway through the outlet of the flowing stack and into the intervention blowout preventer.

DETAILED DESCRIPTION OF THE INVENTION

Figure 1:
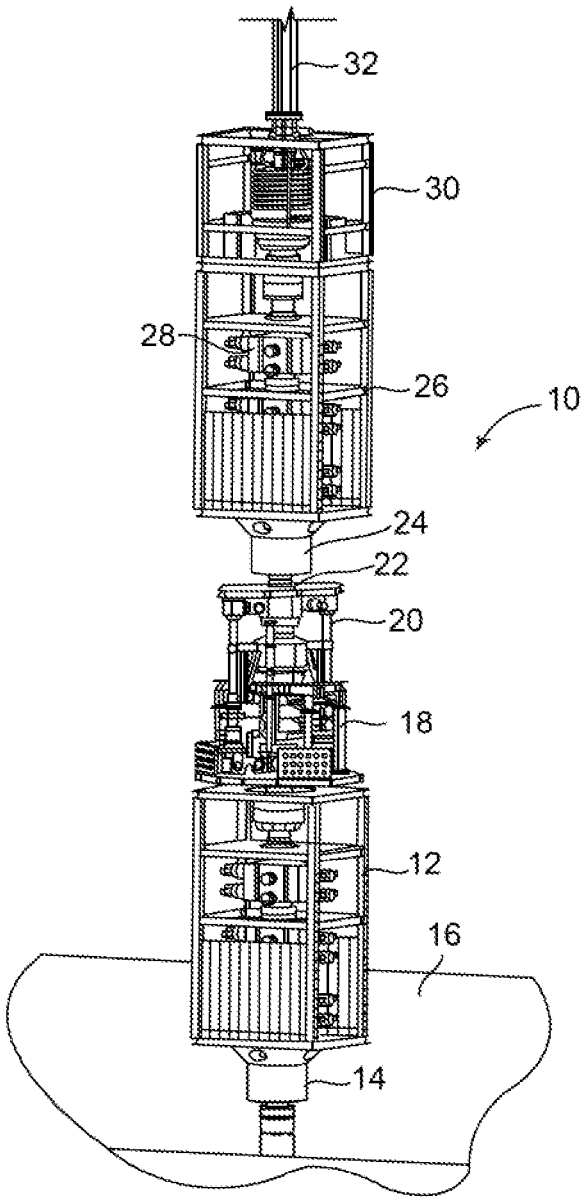
FIG. 1 shows the assembled system of the present invention for capping a damaged blowout preventer.

Referring to FIG. 1, there is shown the system 10 for the capping of a damaged blowout preventer. In particular, it can be seen in FIG. 1 that there is a damaged blowout preventer 12 that is mounted on a wellhead 14 at the sea floor 16. As used herein, the term "damaged", as pertaining to the blowout preventer, can refer to a blowout preventer that is nonfunctional, defectively functional, inoperable, or physically damaged so as to no longer work in a manner desired. Typically, such a damaged blowout preventer will cause the hydrocarbons from the wellhead 14 to spew outwardly through the outlet of the blowout preventer. In other words, the rams on the interior of the blowout preventer have failed to function properly so as to close off the wellhead and prevent the release of hydrocarbons. Quite clearly, when such a damaged blowout preventer occurs, there is immediate need for action in view of the emergency conditions.

Initially, a capping stack 18 is affixed to the blowout preventer 12. The capping stack 18 can be installed onto the mandrel of the damaged blowout preventer 12 so as to be in sealing relation therewith. A flowing stack 20 is illustrated as mounted onto the capping stack 18. The flowing stack 20 will have a mandrel 22 at an upper end thereof. As such, the connector 24 of an intervention blowout preventer 26 can be securely affixed thereto. The intervention blowout preventer will have rams 28 that effectively close the flow of hydrocarbons therethrough. A lower marine riser package 30 is secured to the intervention blowout preventer 26 and has a choke-and-kill line 32 extending upwardly therefrom. The choke-and-kill line 32 can extend upwardly to a surface location.

In the configuration of the system of FIG. 1, the capping stack 18 serves to divert the flow of hydrocarbons from the outlet of the damaged blowout preventer 12. The flowing stack 20 receives the diverted flow from the capping stack and transmits such flow into an interior passageway located at the mandrel 22 at the upper end of the flowing stack 20. As such, the flow of hydrocarbons can pass, in a conventional fashion, into the interior of the intervention blowout preventer 26 for containment. The rams 28 of the intervention blowout preventer 26 can be opened, as desired, so as to allow for the flow of hydrocarbons outwardly therefrom and into the choke-and-kill line 32 for delivery to a surface location.

Importantly, in the present invention, all of the components are formed of rigid steel material. As such, the system 10 of the present invention can accommodate fluid pressures of up to 15,000 p.s.i. The present invention avoids the use of any hoses, connections, manifolds, or other apparatus use to pass the diverted flow of fluid outwardly of the capping stack. Since each connection is solidly and securely made by an ROV, such high pressures can be accommodated.

Whenever such emergency conditions occur, there often relief wells that are drilled in proximity to the damaged well. As such, blowout preventers have already been transported to the desired location. As such, the intervention blowout preventer 26 would be readily available for placement onto the flowing stack 20 and upon the capping stack 18 for the containment of the hydrocarbons from the damaged blowout preventer 12.

Figure 2:
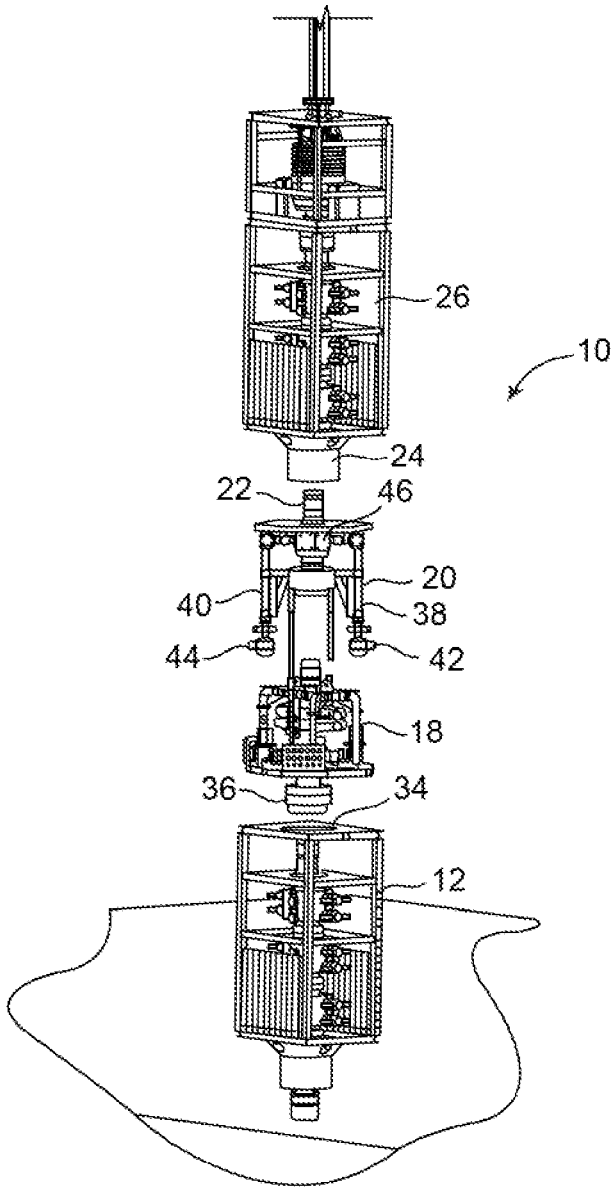
FIG. 2 is an exploded view showing the system of the present invention for the capping of a damaged blowout preventer.

FIG. 2 is an exploded view showing the system 10 of the present invention. As can be seen, the damaged blowout preventer 12 has an outlet 34 located at an upper end thereof. A connector 36 at the bottom of the capping stack 18 can be suitably engaged with the outlet 34 of the damaged blowout preventer 12. To install the connector 36, it is only necessary to lower the capping stack 18 onto the outlet 34 of the blowout preventer 12 such that the flow of hydrocarbons through the interior of the blowout preventer 12 is passed into the fluid passage of the capping stack 18.

The flowing stack 20 is positioned over the capping stack 18. The flowing stack 20 includes pipes 38 and 40 extending downwardly therefrom. A connector 42 is located at the inlet of the pipe 34. Another connector 44 is located at the inlet end of the pipe 40. Each of the pipes 38 and 40 extends vertically upwardly so as to pass into an interior passageway 46 of the flowing stack 20. The mandrel 22 serves as an outlet for the fluids passing into the interior passageway 46. Mandrel 22 is in a position suitable for connection with the connector 24 of the intervention blowout preventer 26. Installation of these components can be carried out using a conventional ROV.

Figure 3:
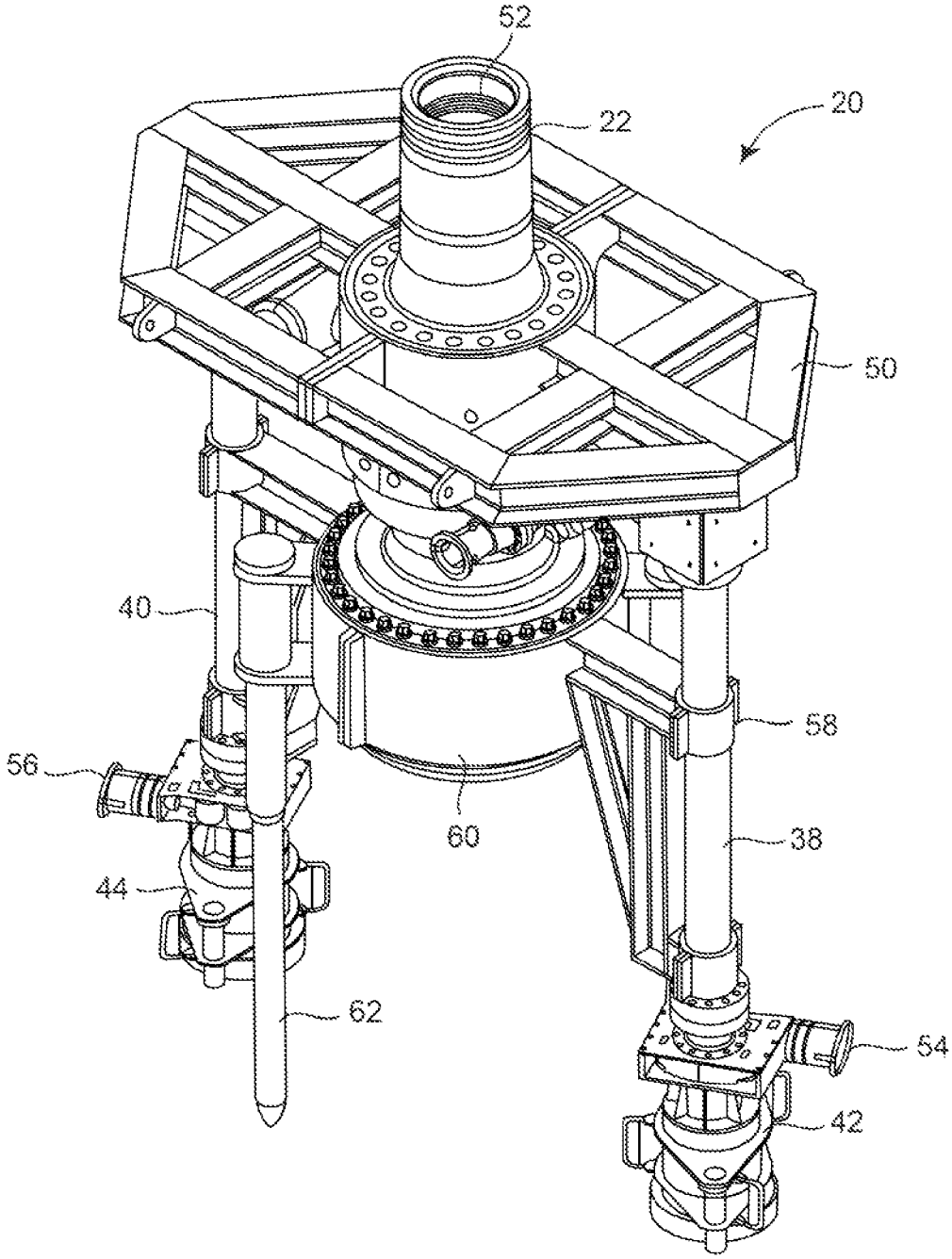
FIG. 3 is a perspective view of the flowing stack as utilized in the system of the present invention.

FIG. 3 is perspective view of the flowing stack 20 of the present invention. Initially, there is a frame 50 that serves as the structure for the flowing stack 20. Mandrel 22 extends outwardly and upwardly from the frame 50. The mandrel 22 includes suitable connection surfaces for engagement with the connector 24 of the intervention blowout preventer 26. The mandrel 22 has the interior passageway 52 extending therethrough. As such, the mandrel 22 serves as the outlet for fluids from the flowing stack 20.

The flowing stack 20 includes a first pipe 38 and a second pipe 40 extending downwardly therefrom. The first pipe 38 has connector 42 located at the inlet thereof. Pipe 40 has connector 44 at the inlet thereof. Suitable hydraulic mechanisms 54 and 56 are cooperative with the connectors 42 and 44 so as to allow a conventional ROV to carry out suitable manipulations so that the connectors 42 and 44 can be sealed in position over the diverter lines of the capping stack, to be described hereinafter. The pipes 38 and 40 are pipe spools. A pipe spool reinforcement frame 58 is connected to frame 50 so as to provide for support for the pipes 38 and 40. As will be described hereinafter, the pipes 38 and 40 will be in valved fluid communication with the interior passageway 52 in the body 60 of the flowing stack 20. A guide post 62 is affixed to the frame 50 and/or to the pipe spool reinforcement frame 58 and extends downwardly therefrom. The guide post 62 extends downwardly so as to be in alignment with suitable receiving funnels associated with capping stack 18.

Figure 4:
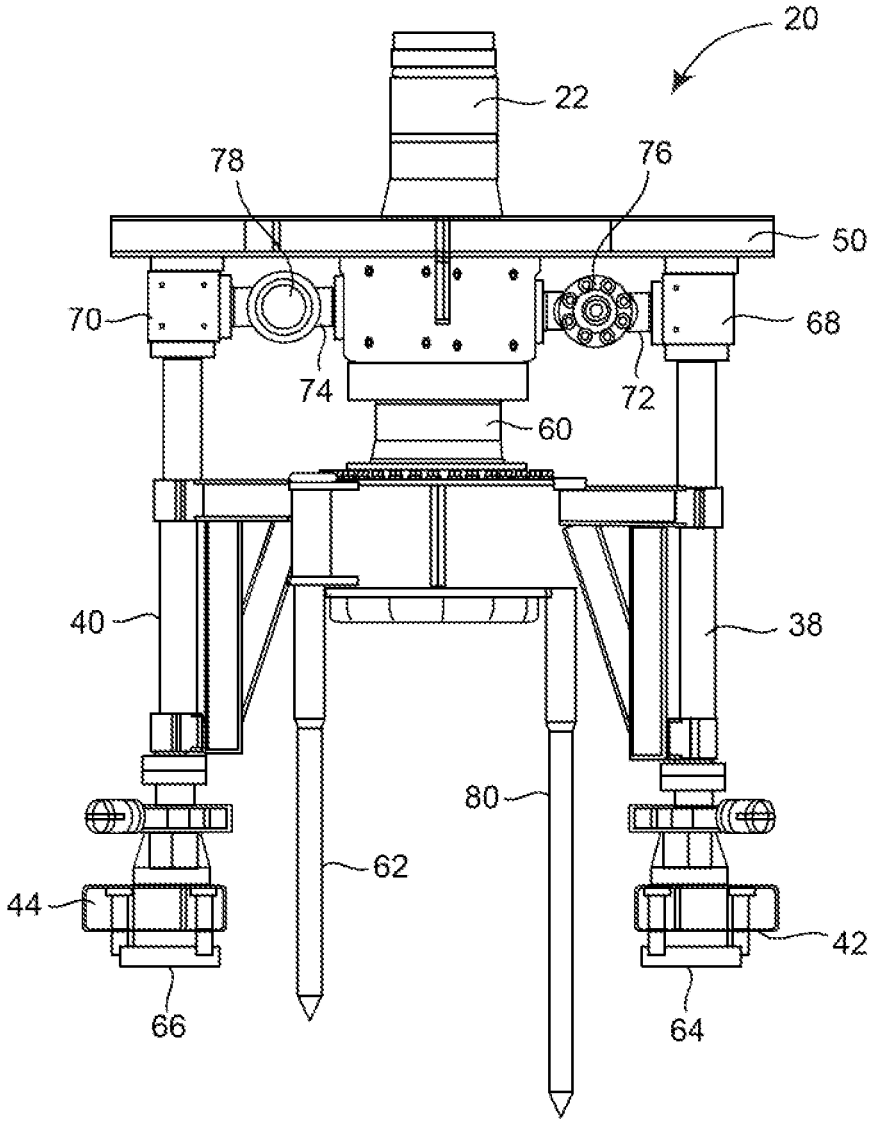
FIG. 4 is a side elevational view of the flowing stack as utilized in the system of the present invention.

FIG. 4 is a side view of the flowing stack 20. The flowing stack 20 includes frame 50 that supports body 60 thereon. The interior passageway 52 will extend into and through the body 64. The mandrel 22 is located above the frame 50 so as to be in a position suitable for connection to the intervention blowout preventer. The first pipe 38 extends vertically downwardly relative to the frame 50. Similarly, the second pipe 40 extends vertically downwardly from the frame 50. The first connector 42 is located at the inlet 64 of the first pipe 38. Similarly, the connector 44 is located at the inlet 66 of the first pipe 40. A forged elbow 68 is connected to the upper end of the vertical pipe 38. Another forged elbow 70 is located at the upper end of the second pipe 40. The forged elbow 68 will cause the flow of fluid through the first pipe 38 to pass into a conduit 72 toward the interior passageway 52 of the body 60. Similarly, the forged elbow 70 will cause the flow of fluid through the second pipe 40 to flow into a conduit 74 extending into the interior passageway 52. An isolation valve 76 is positioned on conduit 72 so as to control the flow of fluid therethrough. Similarly, another isolation valve 78 is positioned on the conduit 74 to also control the flow of fluid therethrough.

In FIG. 4, it can be seen that there is first guide post 62 that extends vertically downwardly from the frame. The second guide post 80 has a length that is greater than the first guide post 62. As will be described hereinafter, the different lengths of the guide posts 62 and 80 are important of the installation of the flowing stack 20 upon the capping stack 18. When the longer guide post 80 is inserted into the funnel that opens at the upper end of the capping stack 18, the ROV can suitably rotate the flowing stack 20 to a desired position in which the shorter guide post 62 overlies another funnel located on the capping stack 18. As such, the different lengths of the guide posts 62 and 80 facilitates the alignment and installation of the flowing stack 20 upon the capping stack 18.

Figure 5:
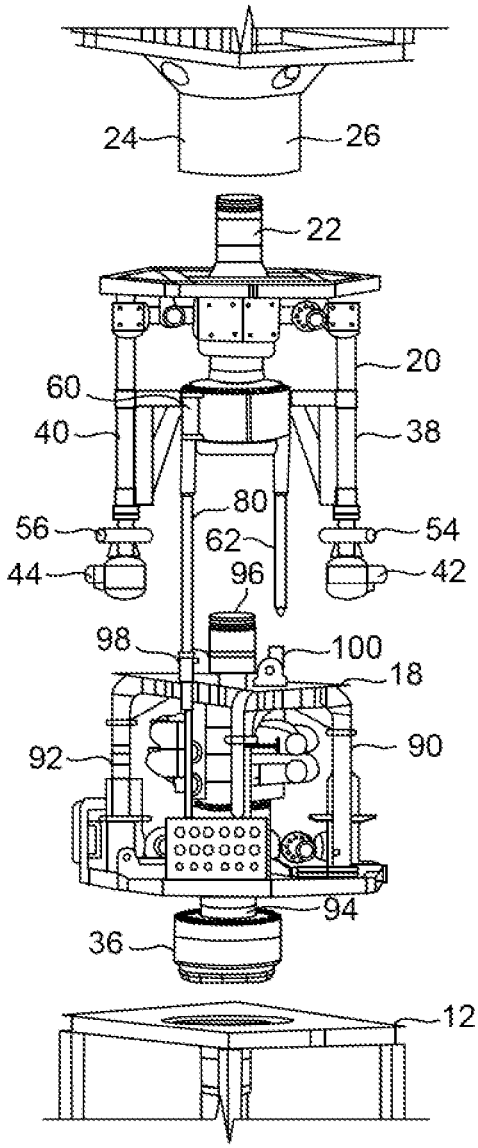
FIG. 5 shows a first step in the assembly of the flowing stack onto the capping stack of the present invention.

FIG. 5 is an exploded view showing the initial step of the installation of the flowing stack 20 upon the capping stack 18. It can be seen that the capping stack 18 has a first diverter 90 extending upwardly therefrom. A second diverter 92 also extends upwardly therefrom. The diverters 90 and 92 communicate, in valved communication, with the fluid passage 94 on the interior of the capping stack 18. The capping stack 18 has numerous valves and controls which can be manipulated so as to control the flow of hydrocarbons therethrough. In particular, each of the diverters 90 and 92 can be opened or closed as desired.

In order to install the capping stack 18 upon the damaged blowout preventer 12, it is necessary to install the connector 36 be affixed upon the upper outlet of the damaged blowout preventer 12. The diverter lines 90 and 92 will be opened along with the fluid passageway extending through the interior of the capping stack 18 from the connector 36 to the outlet 96. As such, an open flow of hydrocarbons is allowed to pass through the fluid passage. If the fluid passage were in any way restricted, then the pressure of the hydrocarbon release from the damaged blowout preventer 12 would prevent the ROV from effectively securing the capping stack 18 upon the blowout preventer 12. The hydrocarbon flow can be released into the seawater until such time as the capping stack 18 is properly installed upon the blowout preventer 12. Once the capping stack 18 is properly installed upon the blowout preventer 12, the valves associated with the fluid passage and the diverter lines 90 and 92 can be suitably closed.

The flowing stack 20 can then be lowered toward the capping stack 18. The guide posts 62 and 80 are lowered until the longer guide post 80 is received within a guide funnel 98. As such, the ROV can suitably rotate the flowing stack 20 until such time as the shorter guide post 62 is properly aligned with the other guide funnel 100. The flowing stack 20 can then be lowered until each of the guide posts 62 and 80 are properly nested within the guide funnels 98 and 100. The outlet 96 of the capping stack 18 is then received within the interior of the body 60 of the flowing stack 20. The outlet 96 can then communicate with the fluid passage of the flowing stack 20. Simultaneously, the first pipe 38 and the second pipe 40 are lowered until the respective connectors 42 and 44 are positioned over the diverter lines 90 and 92, respectively. An ROV can then be used so as to manipulate the proper controls 54 and 56 so as to lock the pipes 38 and 40 onto the outlets of the diverter lines 90 and 92 in a fluid-tight manner. The intervention blowout preventer 26 can then be lowered so that the connector 24 will engage with the mandrel 22 of the flowing stack 20.

Figure 6:
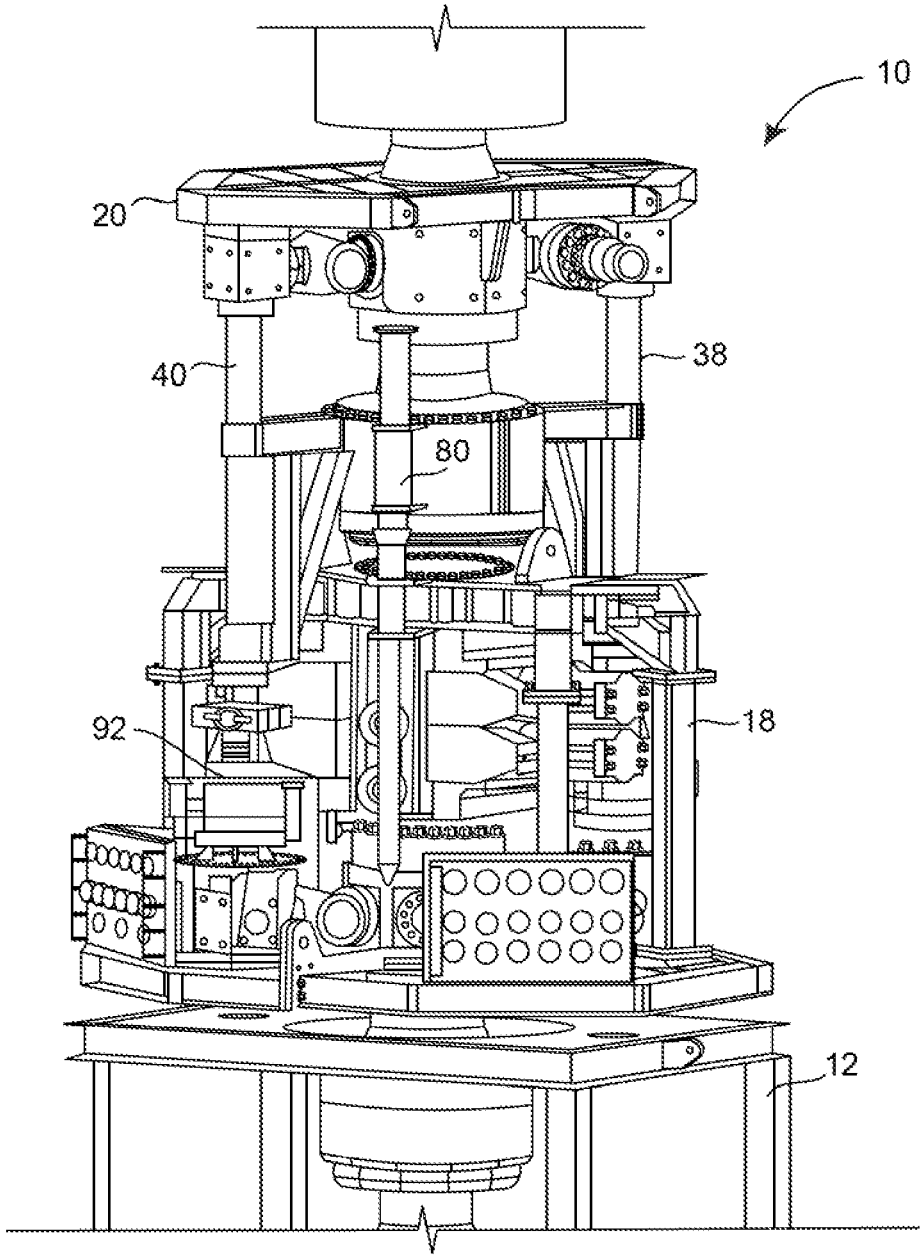
FIG. 6 is a perspective view showing the completed assembly of the flowing stack onto the capping stack of the present invention.

FIG. 6 illustrates the completed construction of the system 10 of the present invention. It can be seen that the guide posts 62 and 80 are properly nested within the guide funnels of the capping stack 18. The pipes 38 and 40 are properly connected to the outlet ends of the diverters 90 and 92. As such, any flow of hydrocarbons passing from the damaged blowout preventer 12 will pass into the fluid passage of the capping stack 18. In particular, the hydrocarbons would flow into the fluid passage of the capping stack 18 and outwardly through the diverter lines 90 and 92 and then into the pipes 38 and 40 so as to ultimately reach the interior passageway associated with the flowing stack 20. The hydrocarbons would then flow outwardly through the outlet of the flowing stack 20 into the inlet of the intervention blowout preventer.

Figure 7:
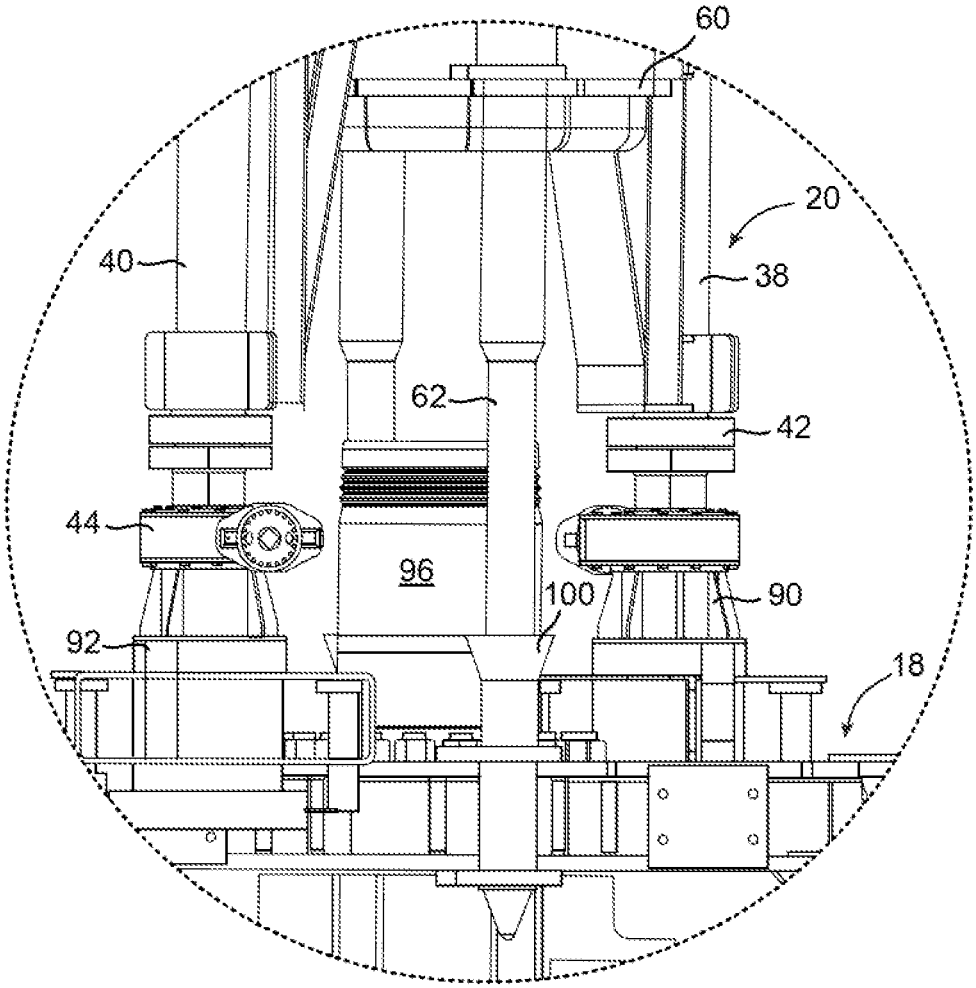
FIG. 7 is a detailed view showing the connection between the flowing stack and the capping stack of the present invention.

FIG. 7 is a detailed view showing the connection between capping stack 18 and the flowing stack 20. In particular, the pipe 38 of the flowing stack 20 is secured by connector 42 to the diverter line 90 of the capping stack 18. Similarly, the pipe 40 of the flowing stack 20 is connected by connector 44 to the diverter line 92 of the capping stack 18. The guide post 62 is suitably received within the funnel 100 of the capping stack 18. Similarly, the body 60 of flowing stack 20 is secured to the outlet 96 of the capping stack 18.

Unlike the prior art, the present invention provides a secure connection between the various components associated with the damaged blowout preventer. In particular, since rigid steel pipes are connected together in a solid and secure manner, fluid pressures of up to 15,000 p.s.i. can be accommodated by the system 10 of the present invention. All of the flow from the damaged blowout preventer can pass through the diverter lines and through the pipes so as to be delivered to the intervention blowout preventer. It is not necessary to utilize hoses, or other flexible conduits, so as to divert the fluid flow. Since the various components of the present invention can be readily provided to the location of the damaged blowout preventer, installation can be achieved in a simple and effective manner. The present invention can minimize the use of ROVs during such emergency conditions. Additionally, any release of hydrocarbons into the subsea environment is effectively prevented. The hydrocarbons are not wasted since the hydrocarbons can flow upwardly through the choke-and-kill line to the surface for surface for storage and retention.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A system for capping a blowout preventer comprising:

a capping stack having a connector suitable for connection to the blowout preventer, said capping stack having a fluid passage extending from said connector, said capping stack having at least one diverter line in communication with said fluid passage, the diverter line having an outlet;

a flowing stack having an interior passageway extending to a connector at an upper end thereof, said flowing stack having at least one pipe in communication with said interior passageway, the pipe connected with the diverter line of said capping stack such that a flow fluid passing through the diverter line passes through the pipe into the interior passageway of said flowing stack; and an intervention blowout preventer connected to said connector of said flowing stack.

2. The system of claim 1, further comprising:

a lower marine riser package affixed to as connector of said intervention blowout preventer at an end opposite said flowing stack; and a choke-and-kill line connected to said lower marine riser package, said choke-and-kill line extending upwardly therefrom.

3. The system of claim 1, said at least one diverter line comprising:

a first diverter line in valved communication with said fluid passage of said capping stack; and a second diverter line in valved communication with said fluid passage of said capping stack.

4. The system of claim 3, said at least one pipe comprising:

a first pipe in communication with said interior passageway of said flowing stack, said first pipe connected to said first diverter line; and a second pipe in communication with said interior passageway of said flowing stack, said second pipe connected to said second diverter line.

5. The system of claim 1, said capping stack having a mandrel at an upper end thereof, said flowing stack having another connector engaged with said mandrel of said capping stack.

6. The system of claim 1, said capping stack having a guide funnel opening at an upper end thereof, said flowing stack having a guide post slidably received in said guide funnel of said capping stack.

7. The system of claim 6, said guide funnel of said capping stack comprising a first guide funnel and a second guide funnel in spaced relation to said first guide funnel, said guide post of said flowing stack comprising a first guide post received in said first guide funnel and a second guide post received in said second guide funnel.

8. The system of claim 7, said first guide post having a length shorter than a length of said second guide post.

9. The system of claim 1, said at least one diverter line and said at least one pipe each having a capacity of 15,000 psi.

* * * * *